US009210500B2

(12) United States Patent
Allen et al.

(10) Patent No.: US 9,210,500 B2
(45) Date of Patent: Dec. 8, 2015

(54) HEADSET TYPE DETECTION AND CONFIGURATION TECHNIQUES

(75) Inventors: Daniel John Allen, Austin, TX (US); Thuan Luong Nguyen, Austin, TX (US); Anand S. Ilango, Austin, TX (US); John Christopher Tucker, Austin, TX (US)

(73) Assignee: CIRRUS LOGIC, INC., Austin, TX (US)

( * ) Notice: Subject to any disclaimer, the term of this patent is extended or adjusted under 35 U.S.C. 154(b) by 235 days.

(21) Appl. No.: 13/588,021

(22) Filed: Aug. 17, 2012

(65) Prior Publication Data

US 2014/0050330 A1 Feb. 20, 2014

(51) Int. Cl.

| | |
|---|---|
| ***H04R 1/10*** | (2006.01) |
| ***H04R 3/00*** | (2006.01) |
| ***H04R 29/00*** | (2006.01) |
| *H04R 5/033* | (2006.01) |
| *H04R 5/04* | (2006.01) |

(52) U.S. Cl.

CPC ..... *H04R 3/00* (2013.01); *H04R 29/00* (2013.01); *H04R 5/033* (2013.01); *H04R 5/04* (2013.01); *H04R 2420/05* (2013.01)

(58) Field of Classification Search

CPC ... H01R 24/58; H01R 13/703; H04M 1/6058; H04R 2420/05; H04R 2420/09

USPC ..... 381/74, 370, 375, 384, 58, 123; 455/575.2; 379/430; 439/620.01, 668, 439/669, 488

See application file for complete search history.

(56) References Cited

U.S. PATENT DOCUMENTS

| | | | | |
|---|---|---|---|---|
| 7,450,726 | B2 * | 11/2008 | Goyal | 381/74 |
| 7,620,432 | B2 * | 11/2009 | Willins et al. | 455/575.1 |
| 7,912,501 | B2 | 3/2011 | Johnson et al. | |
| 8,718,296 | B2 * | 5/2014 | Chang | 381/74 |
| 2001/0053228 | A1 | 12/2001 | Jones | |
| 2007/0049103 | A1 * | 3/2007 | Kashi et al. | 439/396 |
| 2007/0164861 | A1 | 7/2007 | Sano | |
| 2009/0296952 | A1 | 12/2009 | Pantfoerder et al. | |
| 2010/0069114 | A1 | 3/2010 | Lee et al. | |
| 2012/0142225 | A1 * | 6/2012 | Hansson et al. | 439/669 |
| 2012/0200172 | A1 | 8/2012 | Johnson et al. | |
| 2012/0237051 | A1 * | 9/2012 | Lee | 381/74 |
| 2012/0263313 | A1 * | 10/2012 | Yu et al. | 381/74 |
| 2013/0142350 | A1 * | 6/2013 | Larsen et al. | 381/74 |
| 2013/0158919 | A1 * | 6/2013 | Shah et al. | 702/64 |

* cited by examiner

*Primary Examiner* — Xu Mei
*Assistant Examiner* — Jason R Kurr
(74) *Attorney, Agent, or Firm* — Mitch Harris, Atty at Law, LLC; Andrew M. Harris

(57) ABSTRACT

A circuit including headset type detection provides compatibility with different transducer types, such as headphones provided by different manufacturers. An audio circuit that generates or receives an audio signal includes electrical terminals for coupling to a transducer device, at least one of which carries the audio signal. A transducer device type detection circuit is included and detects a type of a transducer device coupled to the audio device from characteristics measured at the multiple electrical terminals when the transducer is coupled to the audio device. The circuit also includes a configuration control circuit for altering a configuration of the audio device according to a detected type of the transducer device.

32 Claims, 6 Drawing Sheets

HEADSET TYPE DETECTION AND CONFIGURATION TECHNIQUES

BACKGROUND OF THE INVENTION

1. Field of the Invention

The present invention relates generally to circuits for personal audio devices such as wireless telephones and media players, and more specifically, to circuits and methods that detect a headset type and audio circuits that reconfigure to adapt to different headset types.

2. Background of the Invention

Wireless telephones, personal media players, and other devices that provide connections for headsets incorporating one or more transducers, frequently use an industry-standard connector for connection of the headset, even in situations in which the headset has a proprietary design. While such designs may become industry standards themselves in some cases, and become a de facto industry-standard, in other cases consumers have the option of selecting, properly or improperly for a given device, from multiple headset types. Some of those headset options are not functionally interchangeable between devices. In some cases, the pin configurations differ, and in other cases the transducers may be different, for example some headsets include microphones, while others do not. Thus a user of a personal audio device or wireless telephone may have a collection of headsets, some of which are compatible with a particular device, and others which are not. Furthermore, headsets available for sale may be limited in certain locations to a particular type or types, so that the exact headset produced for a particular device may not be available to a user for purchase, for example, when a headset breaks or is lost when traveling.

Therefore, it would be desirable to provide a personal audio device that provides compatibility with multiple headset types.

SUMMARY OF THE INVENTION

The above stated objective of providing compatibility among multiple headset types is provided in a circuit within a personal audio device, an integrated circuit, and methods of operation of the circuit.

The circuit is an audio circuit that generates or receives an audio signal and includes electrical terminals for coupling to a transducer device, at least one of which carries the audio signal. The circuit also includes a transducer device type detection circuit for detecting a type of a transducer device coupled to the audio device from characteristics measured at the multiple electrical terminals. The circuit also includes a configuration control circuit for altering a configuration of the audio device according to a detected type of the transducer device.

The foregoing and other objectives, features, and advantages of the invention will be apparent from the following, more particular, description of the preferred embodiment of the invention, as illustrated in the accompanying drawings.

DESCRIPTION OF ILLUSTRATIVE EMBODIMENT

The present invention encompasses personal audio devices, such as wireless telephones, media players, and other consumer personal audio playback devices that detect a headset type of a connected headset and reconfigure their circuits to accommodate different headset types and/or indicate to the user that a connected headset is incompatible.

Figure 1:
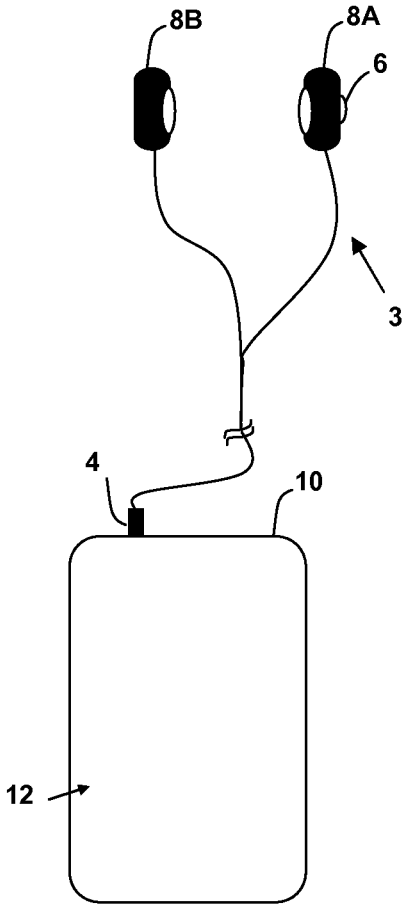
FIG. 1 is an illustration of a personal audio device 10.

FIG. 1 shows a example of a personal audio device 10 connected to a headset 3 in the form of a pair of earbud speakers 8A and 8B, one of which includes a microphone element 6. Headset 3 is only exemplary, and it is understood that personal audio device 10 can be used to detect and adapt to a variety of headset types, including headphones, earbuds, in-ear earphones, and external speakers. A standardized plug 4 provides for connection of headset 3 to personal audio device 10. While plug 4 is standardized in mechanical configuration, the connections of headset 3 may vary between types. Also, the number of electrical contacts may vary between configurations, depending on how many transducers are included in headset 3. For example, by including one or more ring terminals disposed between the tip and shell (barrel) terminals of a phone type connector, the number of terminals can be changed. Personal audio device 10 provides a display to a user and receives user input using a touch screen 12, or alternatively, a standard LCD may be combined with various buttons, sliders, and/or dials disposed on the face or sides of personal audio device 10.

Figure 2A:
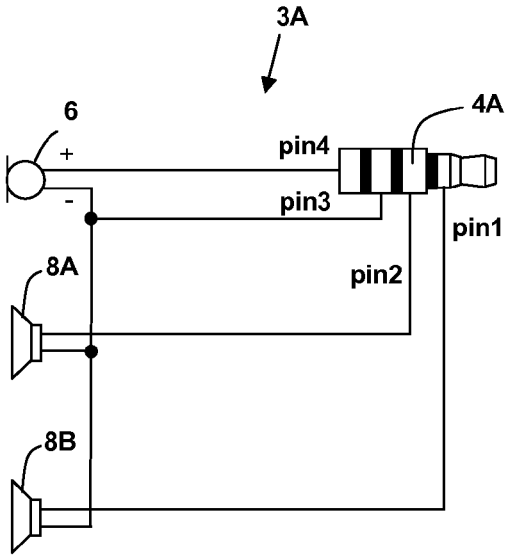
FIGS. 2A and 2B are schematic diagrams depicting different headset types that can be detected by personal audio device 10.

Referring now to FIG. 2A, a headset 3A of a first type is illustrated, that may be detected by personal audio device 10 and for which personal audio device 10 can be configured for proper operation. In headset 3A, the backmost ring terminal electrical signal pin3 of a plug 4A is used as a common return signal for earbud speakers 8A, 8B and microphone element 6. A shell terminal electrical signal pin4 is connected to microphone element 6, a tip signal pin1 is connected to earbud speaker 8B, and a front-most ring terminal electrical signal pin2 is connected to earbud speaker 8A.

Figure 2B:
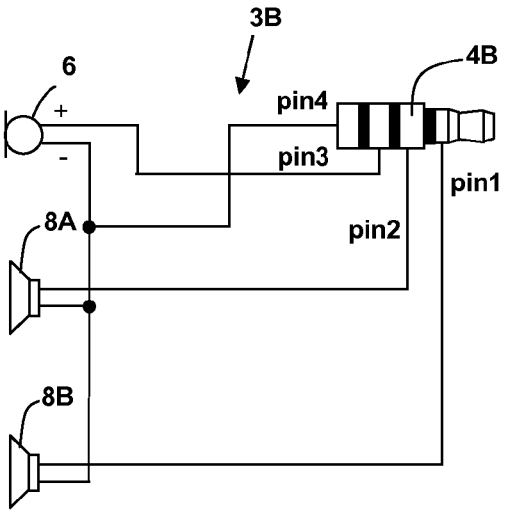

Referring now to FIG. 2B, a headset 3B of a second type is illustrated, that may be detected by personal audio device 10 and for which personal audio device 10 can be configured for proper operation. In headset 3B, shell terminal electrical signal pin4 of a plug 4B is used as a common return signal for earbud speakers 8A, 8B, and microphone element 6. Backmost ring terminal electrical signal pin3 is connected to microphone element 6, tip signal pin1 is connected to earbud speaker 8B and front-most ring terminal electrical signal pin2 is connected to earbud speaker 8A. While headset 3B has the same elements and plug type as headset 3A of FIG. 2A and may be mechanically fitted to personal audio device 10, without electrical reconfiguration, headset 3A and headset 3B are not electrically interchangeable, and at least one of headset 3A and headset 3B will not operate properly.

Figure 3:
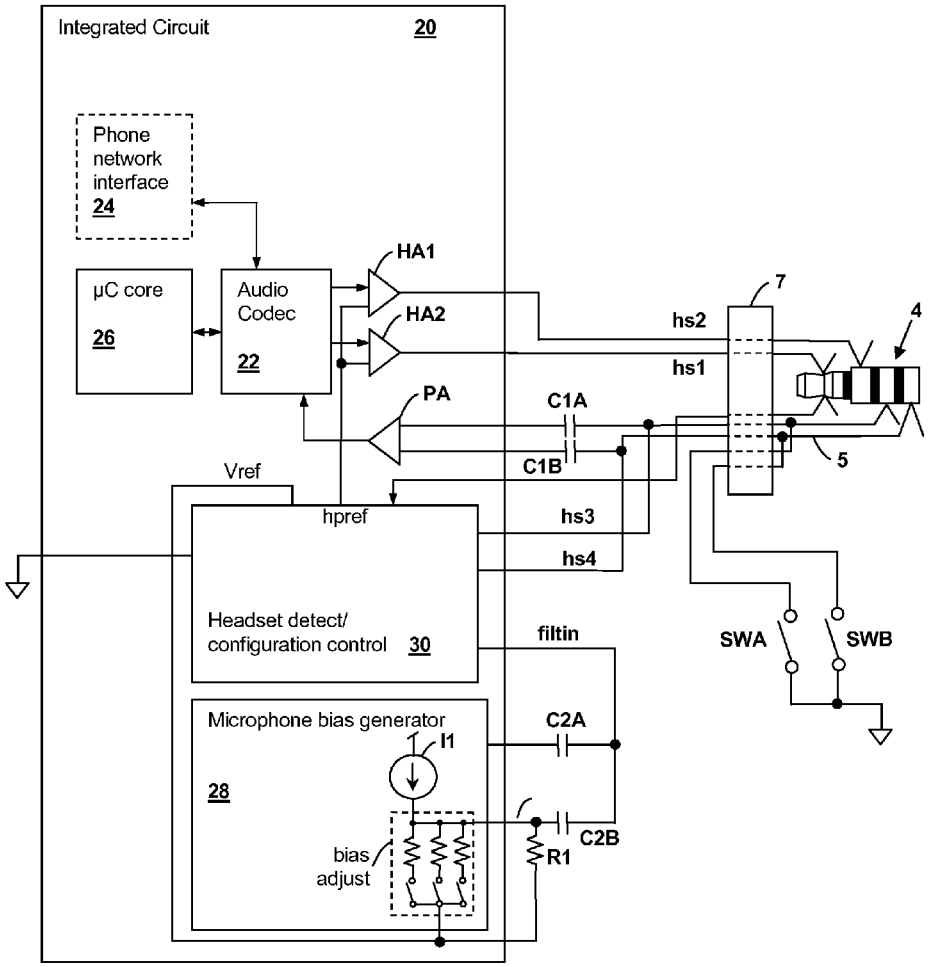
FIG. 3 is a simplified schematic diagram depicting internal circuits of personal audio device 10.

FIG. 3 shows an integrated circuit 20 that includes an audio codec 22 coupled to a microcontroller core 26, and that may optionally receive input from, and provide an output to, a phone network interface 24 if personal audio device 10 is a wireless telephone. Audio codec 22 is coupled to a jack 5 that is mechanically and electrically configured to receive plug 4, which may be plug 4A of headset 3A of FIG. 2A, plug 4B of headset 3B of FIG. 2B, or another plug of a headset that can be detected and adapted to by integrated circuit 20. A set of buttons SWA and SWB can be provided to personal audio device 10 as shown or on an attached headset. In order to detect the headset type of a headset connected to jack 6 and to adapt the electrical configuration of integrated circuit 20 thereto, integrated circuit 20 includes a headset detection and configuration control logic 30. Headset detection and configuration control logic 30 controls the coupling of electrical signals hs3 and hs4 to internal signals of integrated circuit 20, so that the common reference signal and microphone output signals are exchanged between electrical signals pin3 and pin4 of an attached headset. Headphone amplifiers HA1 and HA2 couple electrical signals pin2 and pin1, respectively, to outputs of audio codec 22 and are connected in a permanent configuration, but the depicted circuit is only exemplary and the connections to electrical signals pin2 and pin1 can also be reconfigured via switches. Headphone amplifiers HA1 and HA2 are biased by signal hpref. A microphone preamplifier PA is coupled to electrical signals hs3 and hs4 via external capacitors C1A and C1B. Isolation filters 7 are provided between contacts of jack 5 and signals hs1-hs4, which may be capacitors, LC filters, or other filter configurations as required to prevent transmission and/or reception of electromagnetic interference (EMI) between IC 20 and a connected headset. A microphone bias generator 28 provides a bias voltage for operation of the microphone element, and in accordance with an embodiment of the present invention, provides the bias voltage to detect the configuration of a headset connected to jack 5. Microphone bias generator 28 includes a bias adjust circuit that permits selection of the voltage level applied between signals hs3 and hs4 to bias a microphone element included within a headset connected to jack 5. Microphone bias generator 28, in combination with an external resistor R1, provides the return path for a current supplied by a current source I1 and thereby sets the bias voltage $V_{ref}$ imposed on electrical signals hs3 and hs4, as will be described in further detail below, and which is used to determine which of electrical signals hs3 and hs4 is connected to a common headset terminal, and which is connected to a microphone element terminal when a headset plug 4 is inserted in jack 5. Capacitors C2A and C2B form part of a filter that is used by microphone bias generator 28 to generate a low-noise microphone DC bias voltage $V_{ref}$ by controlling the impedance presented to current source I1. A signal filtin is coupled to the common terminal of a connected headset to provide a reference for microphone bias generator 28 once configuration is complete, but is left unconnected during headset detection.

Figure 4:
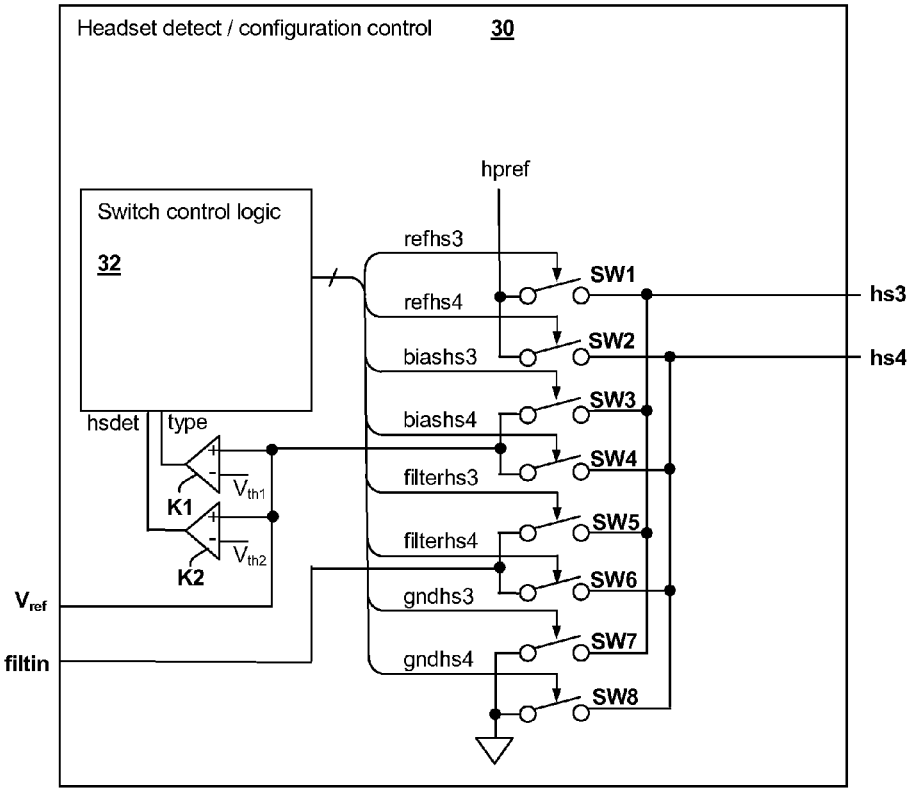
FIG. 4 is a simplified schematic diagram depicting details of headset detect/configuration control block 30 of FIG. 3.

FIG. 4 shows details of headset detection and configuration control logic 30. A set of switches SW1-SW8 are coupled to either electrical signal hs3 or electrical signal hs4, and depending on the state of corresponding control signals refhs3, refhs4, biashs3, biashs4, filterhs3, filterhs4, gndhs3, and gndhs4, configure the connections of internal signals of headset detection and configuration control logic 30 to electrical signal hs3 and electrical signal hs4 to detect a type of a headset that is connected to jack 5, and to subsequently configure integrated circuit 20 for proper operation with the headset. A switch control logic 32, controls the state of switches SW1-SW8 by generating control signals refhs3, refhs4, biashs3, biashs4, filterhs3, filterhs4, gndhs3 and gndhs4, either via dedicated logic and a state machine that control the detection and operational configuration of the switch states, or a microcontroller such as microcontroller core 26 of FIG. 3 may provide for configuration of the control signals. A comparator K1 provides an indication, as output signal type, of whether the voltage $V_{ref}$ on either electrical signal hs3 as selected by activating switch SW3, or electrical signal hs4 as selected by activating switch SW4, exceeds a threshold voltage $V_{th1}$. If a microphone element is connected between electrical signal hs3 and electrical signal hs4, the polarity of the microphone element can be determined from changes in the state of comparator K1, when switch SW3 is activated, and then when switch SW3 is deactivated and switch SW4 activated. A second comparator K2 is used to compare voltage $V_{ref}$ to a second threshold voltage $V_{th2}$ to determine whether or not a headset button, e.g. button SWA or button SWB, is activated on a connected headset. Switches SW1 and SW2 select which of electrical signals hs3 or hs4 is coupled to headphone amplifier reference signal hpref.

Figure 5:
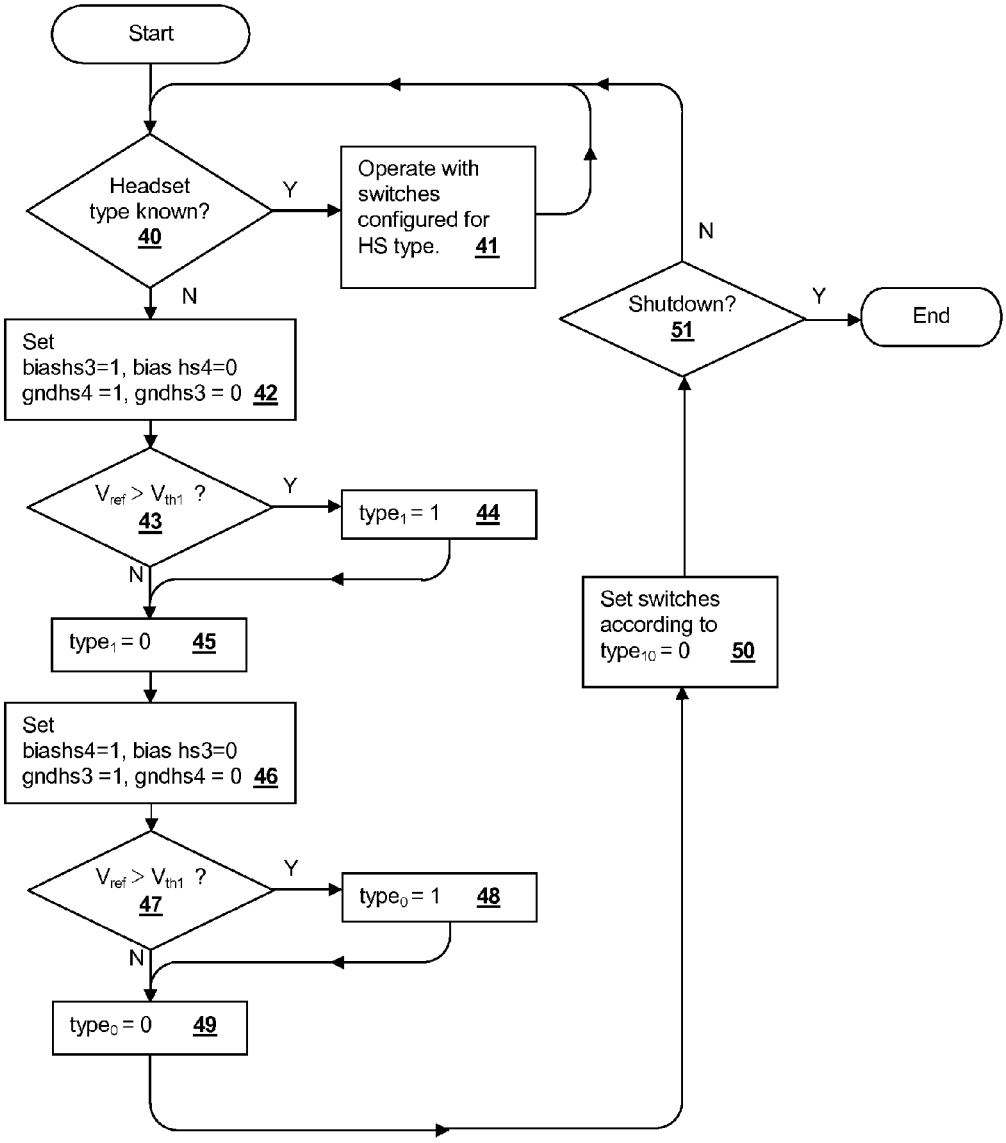
FIG. 5 is a flowchart depicting operation of a personal audio device.

FIG. 5 shows a method for detecting the type of a headset connected to jack 5 of the circuit in FIG. 4. If the headset type is known (decision 40), which may be provided by a manual override from a system controller or user input or because the detection algorithm of steps 42-49 has been performed, switches SW1-SW8 are configured (step 41) according to the headset type as illustrated below in Table I. Otherwise, if the headset type is not known (decision 40), then the states of switches SW1-SW8 are manipulated to determine the headset type. In particular, control signal biashs3 is set active to close switch SW3, and control signal gndhs4 is set active to close switch SW8, so that bias voltage $V_{ref}$ is applied across electrical signals hs3 and hs4 (step 42). The output of comparator K1 is observed and if $V_{ref}>V_{th1}$ (decision 43), then state bit $type_1$ is set (step 44), otherwise state bit $type_1$ is cleared (step 45). Next, control signal biashs3 is set inactive to open switch SW3, control signal gndhs4 is set inactive to open switch SW8, control signal biashs4 is set active to close switch SW4, control signal gndhs3 is set active to open switch SW7 (step 46). The output of comparator K1 is again observed and if $V_{ref}>V_{th1}$ (decision 47), then state bit $type_0$ is set (step 48), otherwise state bit $type_0$ is cleared (step 49). The state of switches SW1-SW8 is then set for operation according to the headset type indicated by state bits $type_{10}$, by asserting and de-asserting control signals refhs3, refhs4, biashs3, biashs4, filterhs3, filterhs4, gndhs3 and gndhs4 according to the values shown in Table I for the indicated headset type (step 50). The process from step 40-50 is repeated until the system is shut down (decision 51).

Table I below shows the detected headset type and operating configurations for the circuit shown in FIG. 3 and FIG. 4, and configured according to the method illustrated in FIG. 5:

TABLE I

| | $type_{10}$ | refhs3 | refhs4 | biashs3 | biashs4 | filterhs3 | filterhs4 | gndhs3 | gndhs4 |
|---|---|---|---|---|---|---|---|---|---|
| Detect phase0 | — | 0 | 0 | 1 | 0 | 0 | 0 | 0 | 1 |
| Detect phase1 | — | 0 | 0 | 0 | 1 | 0 | 0 | 1 | 0 |
| Headset type A | 01 | 1 | 0 | 0 | 1 | 1 | 0 | 1 | 0 |

TABLE I-continued

| | $type_{10}$ | refhs3 | refhs4 | biashs3 | biashs4 | filterhs3 | filterhs4 | gndhs3 | gndhs4 |
|---|---|---|---|---|---|---|---|---|---|
| Headset type B | 10 | 0 | 1 | 1 | 0 | 0 | 1 | 0 | 1 |
| Headset no mic | 00 | 1 | 1 | 0 | 0 | 1 | 1 | 1 | 1 |
| Invalid headset | 11 | 1 | 0 | 0 | 1 | 1 | 0 | 1 | 0 |

Figure 6A:
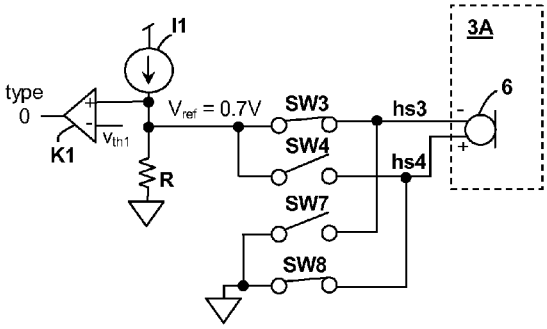
FIGS. 6A-6D are simplified schematic diagrams depicting circuits illustrating the detection of microphone presence and polarity as performed according to the method of FIG. 5.
Figure 6B:
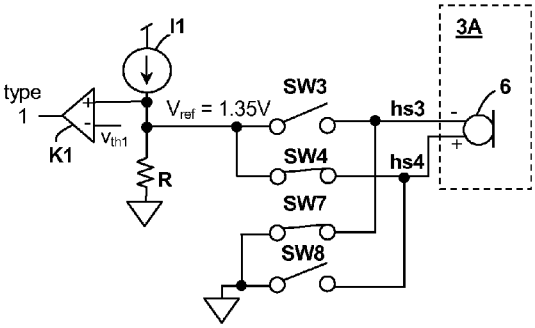

Referring now to FIGS. 6A-6D, the operation of headset detect/configuration control circuit 30 of FIG. 3 and FIG. 4, according to the method of FIG. 5 is illustrated for two different headset types. In FIG. 6A a headset 3A as illustrated in FIG. 2A is connected to jack 5 (not shown), so that microphone element 6 is coupled to electrical signals hs3 and hs4 with a polarity as indicated. In the first detection phase, as illustrated in Table I above, switches SW3 and SW8 are closed, which forward-biases the parasitic diode within microphone element 6. Since the parasitic diode within microphone element 6 is forward-biased, a voltage level $V_{ref}$=0.7V is present at the input to comparator K1 and the output of comparator K1 assumes a logical "0" value. FIG. 6B illustrates the second detection phase, in which switches SW3 and SW8 are opened and switches SW4 and SW7 are closed, which reverse-biases the parasitic diode within microphone element 6. Since the parasitic diode within microphone element 6 is reverse-biased, the input to comparator K1 rises to its open circuit voltage level $V_{ref}$=1.35V and the output of comparator K1 assumes a logical "1" value. The value of $type_{10}$ is therefore captured by the method of FIG. 5 as 01, which corresponds to headset type A, which is the type of headset exemplified by headset 3A of FIG. 2A.

Figure 6C:
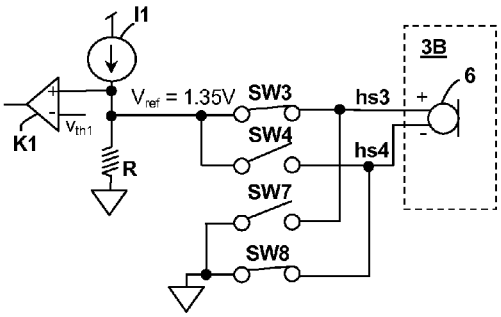
Figure 6D:
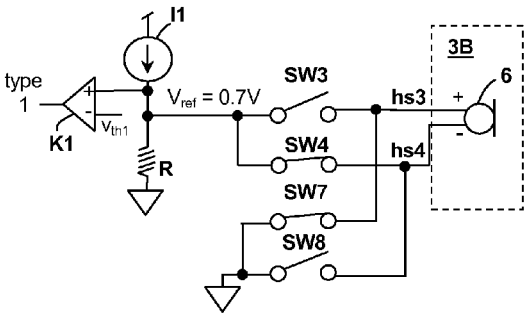

In FIG. 6C, a headset 3B as illustrated in FIG. 2B is connected to jack 5 (not shown), so that microphone element 6 is coupled to electrical signals hs3 and hs4 with a polarity as indicated. In the first detection phase, as illustrated in Table I above, switches SW3 and SW8 are closed, which reverse-biases the parasitic diode within microphone element 6. Since the parasitic diode within microphone element 6 is reverse-biased, the input to comparator K1 rises to its open circuit voltage level $V_{ref}$=1.35V and the output of comparator K1 assumes a logical "1" value. FIG. 6D illustrates the second detection phase, in which switches SW3 and SW8 are opened and switches SW4 and SW7 are closed, which forward-biases the parasitic diode within microphone element 6. Since the parasitic diode within microphone element 6 is forward-biased, a voltage level $V_{ref}$=0.7V is present at the input to comparator K1 and the output of comparator K1 assumes a logical "0" value. The value of $type_{10}$ is therefore captured by the method of FIG. 5 as 10, which corresponds to headset type B, which is the type of headset exemplified by headset 3B of FIG. 2B. The above voltages are only illustrative of a particular type of microphone and a particular set of circuit voltages and are provided for example only. In the illustrative example, a suitable threshold voltage $V_{th1}$ is the midpoint of 0.7V and 1.35V, i.e., threshold voltage $V_{th1}$=1.0V, but threshold voltage $V_{th1}$ should be adapted to the actual voltages expected for the particular circuit and microphone element types employed in a system.

While the invention has been particularly shown and described with reference to the preferred embodiments thereof, it will be understood by those skilled in the art that the foregoing and other changes in form, and details may be made therein without departing from the spirit and scope of the invention.

What is claimed is:

1. An audio device comprising:

an output audio circuit for generating at least one output audio signal;

an audio input circuit for receiving at least one input audio signal;

multiple electrical terminals for coupling a transducer device to the audio device, wherein a first terminal of the multiple electrical terminals is coupled to the at least one output audio signal and a second terminal of the multiple electrical terminals is coupled to the audio input circuit when the audio device is configured in an operational configuration;

a bias circuit for supplying a bias voltage to the second terminal at least when the audio device is configured in a detection configuration;

a transducer device type detection circuit for detecting a type of the transducer device when the transducer device is coupled to the audio device from characteristics measured at the second terminal when the audio device is configured in the detection configuration; and a configuration control circuit for altering the detection configuration to apply the bias voltage in a first polarity and a second polarity to the second terminal, wherein the transducer type detection circuit detects the type of the transducer device from differences between the characteristics measured when the bias voltage is applied in the first polarity and when the bias voltage is applied in the second polarity, wherein the configuration control circuit further alters the operational configuration of the audio device according to the type of the transducer device detected by the transducer device type detection circuit.

2. The audio device of claim 1, wherein the configuration control circuit configures coupling between the multiple electrical terminals and the audio circuit, wherein the configuration control circuit selects from one of multiple operational configurations according to the type of the transducer device detected by the transducer device type detection circuit.

3. The audio device of claim 2, wherein the configuration control circuit comprises a switching circuit that, in a first one of the multiple operational configurations, couples a first set of signals within the audio device to corresponding first ones of the multiple electrical terminals, and in a second one of the multiple operational configurations, couples a second set of signals within the audio device to corresponding second ones of the multiple electrical terminals.

4. The audio device of claim 1, wherein the transducer device type detection circuit measures a voltage or current on the second terminal to detect a presence and the type of the transducer device.

5. The audio device of claim 4, wherein the transducer device type detection circuit detects a polarity of a microphone element included within the transducer device from the differences between the characteristics measured when the bias voltage is applied first polarity and when the bias voltage is applied in the second polarity.

6. The audio device of claim 5, wherein the second terminal is AC coupled to the audio input circuit in the operational configuration and DC coupled to the transducer device type detection circuit in the detection configuration.

7. The audio device of claim 1, wherein the second terminal is AC coupled to the audio input circuit in the operational configuration and DC coupled to the transducer device type detection circuit in the detection configuration.

8. The audio device of claim 1, wherein the transducer device type detection circuit and the configuration control circuit are operated automatically to detect the type of the transducer device and to automatically alter the configuration of the audio device in response thereto.

9. The audio device of claim 1, wherein the transducer device type detection circuit provides an output that is displayable to a user of the audio device, and wherein the configuration control circuit is operated in response to a user input from the user to alter the configuration of the audio device in response thereto.

10. The audio device of claim 1, wherein the type of the transducer device detected by the transducer type detection circuit is selected from a set of transducer device types including one or more headset types.

11. The audio device of claim 1, wherein the type of the transducer device detected by the transducer type detection circuit is selected from a set of transducer device types including a first headset type and a second headset type, wherein the first headset type has a first plug terminal coupled to a first terminal of a first headphone speaker, a second plug terminal coupled to a first terminal of a second headphone speaker, a third plug terminal coupled to a first terminal of a microphone element and a fourth terminal commonly coupled to a second terminal of the first headphone speaker, a second terminal of the second headphone speaker and a second terminal of the microphone, and wherein the second headset type has the first plug terminal coupled to the first terminal of the first headphone speaker, the second plug terminal coupled to the first terminal of the second headphone speaker, the third plug terminal coupled to the first terminal of a microphone element and the fourth terminal commonly coupled to the second terminal of the first headphone speaker, the second terminal of the second headphone speaker and the second terminal of the microphone.

12. A method of determining a type of an external audio transducer coupled to an audio device, the method comprising:

receiving at least one input audio signal with an audio input circuit;

connecting the external audio transducer to the audio device via a connector having multiple electrical terminals, wherein a first terminal of the multiple electrical terminals is coupled to at least one output audio signal and a second terminal of the multiple electrical terminals is coupled to the audio input circuit when the audio device is configured in an operational configuration;

supplying a bias voltage to the second terminal at least when the audio device is configured in a detection configuration with a bias circuit;

detecting a type of the transducer device from characteristics measured at the second terminal when the audio device is configured in the detection configuration;

changing the detection configuration to apply the bias voltage in a first polarity and a second polarity to the second terminal, wherein the detecting detects the type of the transducer device from differences between the characteristics measured when the bias voltage is applied in the first polarity and when the bias voltage is applied in the second polarity, wherein the n control circuit further alters the operational;

altering an operational configuration of the audio device according to the detected type of the transducer device; and providing the at least one output audio signal to the audio transducer via at least one of the electrical terminals.

13. The method of claim 12, wherein the altering configures coupling between the multiple electrical terminals and an audio circuit that provides the audio signal by selecting from one of multiple operational configurations according to the detected type of the transducer device.

14. The method of claim 13, wherein the altering is performed by controlling a switching circuit that, in a first one of the multiple operational configurations, couples a first set of signals within the audio device to corresponding first ones of the multiple electrical terminals, and in a second one of the multiple operational configurations, couples a second set of signals within the audio device to corresponding second ones of the multiple electrical terminals.

15. The method of claim 12, wherein the detecting comprises measuring a voltage or current on the second terminal to detect a presence and the type of the transducer device.

16. The method of claim 14, wherein the detecting detects a polarity of a microphone element included within the transducer device from the differences between the characteristics measured when the bias voltage is applied first polarity and when the bias voltage is applied in the second polarity.

17. The method of claim 16, wherein the second terminal is AC coupled to the audio input circuit in the operational configuration and DC coupled to the transducer device type detection circuit in the detection configuration.

18. The method of claim 12, wherein the second terminal is AC coupled to the audio input circuit in the operational configuration and DC coupled to the transducer device type detection circuit in the detection configuration.

19. The method of claim 12, wherein the detecting and altering are performed automatically, and wherein the altering is performed in response to completing the detecting.

20. The method of claim 12, further comprising displaying a result of the detecting to a user of the audio device, and wherein the configuration control circuit is operated in response to a user input from the user to alter the configuration of the audio device in response thereto.

21. The method of claim 12, wherein the detecting selects from a set of transducer device types including one or more headset types.

22. The method of claim 12, wherein the type of the transducer device detected by the detecting is selected from a set of transducer device types including a first headset type and a second headset type, wherein the first headset type has a first plug terminal coupled to a first terminal of a first headphone speaker, a second plug terminal coupled to a first terminal of a second headphone speaker, a third plug terminal coupled to a first terminal of a microphone element and a fourth terminal commonly coupled to a second terminal of the first headphone speaker, a second terminal of the second headphone speaker and a second terminal of the microphone, and wherein the second headset type has the first plug terminal coupled to the first terminal of the first headphone speaker, the second plug terminal coupled to the first terminal of the second headphone speaker, the third plug terminal coupled to the first terminal of a microphone element and the fourth terminal commonly coupled to the second terminal of the first headphone speaker, the second terminal of the second headphone speaker and the second terminal of the microphone.

23. An integrated circuit, comprising:

an output audio circuit for generating at least one output audio signal;

an audio input circuit for receiving at least one input audio signal;

multiple electrical terminals for coupling the audio circuit to an external transducer device, wherein a first terminal of the multiple electrical terminals is coupled to the at least one output audio signal and a second terminal of the multiple electrical terminals is coupled to the audio input circuit when the audio device is configured in an operational configuration;

a bias circuit for supplying a bias voltage to the second terminal at least when the audio device is configured in a detection configuration;

a transducer device type detection circuit for detecting a type of the transducer device when the transducer device is coupled to the audio device from characteristics measured at the second terminal when the audio device is configured in the detection configuration; and a configuration control circuit for altering the detection configuration to apply the bias voltage in a first polarity and a second polarity to the second terminal, wherein the transducer type detection circuit detects the type of the transducer device from differences between the characteristics measured when the bias voltage is applied in the first polarity and when the bias voltage is applied in the second polarity, wherein the configuration control circuit further alters the operational configuration of the integrated circuit according to the type of the transducer device detected by the transducer device type detection circuit.

24. The integrated circuit of claim 23, wherein the configuration control circuit configures coupling between the multiple electrical terminals and the audio circuit, wherein the configuration control circuit selects from one of multiple operational configurations according to the type of the transducer device detected by the transducer device type detection circuit.

25. The integrated circuit of claim 24, wherein the configuration control circuit comprises a switching circuit that, in a first one of the multiple operational configurations, couples a first set of signals within the integrated circuit to corresponding first ones of the multiple electrical terminals, and in a second one of the multiple operational configurations, couples a second set of signals within the integrated circuit to corresponding second ones of the multiple electrical terminals.

26. The integrated circuit of claim 23, wherein the transducer device type detection circuit measures a voltage or current on the second terminal to detect a presence and the type of the transducer device.

27. The integrated circuit of claim 26, wherein the transducer device type detection circuit detects a polarity of a microphone element included within the transducer device from the differences between the characteristics measured when the bias voltage is applied first polarity and when the bias voltage is applied in the second polarity.

28. The integrated circuit of claim 27, wherein the second terminal is AC coupled to the audio input circuit in the operational configuration and DC coupled to the transducer device type detection circuit in the detection configuration.

29. The integrated circuit of claim 23, wherein the second terminal is AC coupled to the audio input circuit in the operational configuration and DC coupled to the transducer device type detection circuit in the detection configuration.

30. The integrated circuit of claim 23, wherein the transducer device type detection circuit and the configuration control circuit are operated automatically to detect the type of the transducer device and to automatically alter the configuration of the integrated circuit in response thereto.

31. The integrated circuit of claim 23, wherein the type of the transducer device detected by the transducer type detection circuit is selected from a set of transducer device types including one or more headset types.

32. The integrated circuit of claim 23, wherein the type of the transducer device detected by the transducer type detection circuit is selected from a set of transducer device types including a first headset type and a second headset type, wherein the first headset type has a first plug terminal coupled to a first terminal of a first headphone speaker, a second plug terminal coupled to a first terminal of a second headphone speaker, a third plug terminal coupled to a first terminal of a microphone element and a fourth terminal commonly coupled to a second terminal of the first headphone speaker, a second terminal of the second headphone speaker and a second terminal of the microphone, and wherein the second headset type has the first plug terminal coupled to the first terminal of the first headphone speaker, the second plug terminal coupled to the first terminal of the second headphone speaker, the third plug terminal coupled to the first terminal of a microphone element and the fourth terminal commonly coupled to the second terminal of the first headphone speaker, the second terminal of the second headphone speaker and the second terminal of the microphone.

* * * * *

UNITED STATES PATENT AND TRADEMARK OFFICE

CERTIFICATE OF CORRECTION

PATENT NO. : 9,210,500 B2
APPLICATION NO. : 13/588021
DATED : December 8, 2015
INVENTOR(S) : Allen et al.

It is certified that error appears in the above-identified patent and that said Letters Patent is hereby corrected as shown below:

Column 6, lines 36-37, "the transducer type detection circuit" should read -- the transducer device type detection circuit --.

Column 7, line 1, "is applied first polarity" should read -- is applied in the first polarity --.

Column 7, lines 23-24, "the transducer type detection circuit" should read -- the transducer device type detection circuit --.

Column 7, lines 27-28, "the transducer type detection circuit" should read -- the transducer device type detection circuit --.

Column 8, lines 3-4, "wherein the n control circuit further alters the operational" should be removed.

Column 8, line 30, "is applied first polarity" should read -- is applied in the first polarity --.

Column 9, lines 25-26, "the transducer type detection circuit" should read -- the transducer device type detection circuit --.

Column 10, line 9, "is applied first polarity" should read -- is applied in the first polarity --.

Column 10, lines 26-27, "the transducer type detection circuit" should read -- the transducer device type detection circuit --.

Column 10, lines 30-31, "the transducer type detection circuit" should read -- the transducer device type detection circuit --.

Signed and Sealed this
Twenty-ninth Day of March, 2016

Michelle K. Lee

Michelle K. Lee
*Director of the United States Patent and Trademark Office*